US005333734A

United States Patent [19]

Stout et al.

[11] Patent Number: 5,333,734

[45] Date of Patent: Aug. 2, 1994

[54] HEAVY DUTY ARTICLE CARRIER FOR CANS ARRANGED IN A HORIZONTAL POSITION

[75] Inventors: James T. Stout, Ellijay; James B. DeMaio, Marietta, both of Ga.

[73] Assignee: The Mead Corporation, Dayton, Ohio

[21] Appl. No.: 109,165

[22] Filed: Aug. 19, 1993

[51] Int. Cl.[5] ..... B65D 71/34

[52] U.S. Cl. ..... 206/427; 229/117.13

[58] Field of Search ..... 206/139, 140, 427, 428, 206/434; 229/117.13–117.17

[56] References Cited

U.S. PATENT DOCUMENTS

| | | | |
|---|---|---|---|
| 3,904,036 | 9/1975 | Forrer | 206/427 |
| 4,216,861 | 8/1980 | Oliff | 206/427 |
| 4,440,340 | 4/1984 | Bakx | 206/427 |
| 4,577,799 | 3/1986 | Oliff | 206/427 |
| 4,588,084 | 5/1986 | Holley, Jr. | 206/427 |
| 4,830,267 | 5/1989 | Wilson | 206/427 |
| 5,197,598 | 3/1993 | Stout et al. | 206/427 |
| 5,221,042 | 6/1993 | Oliff | 206/427 |

FOREIGN PATENT DOCUMENTS

| | | | |
|---|---|---|---|
| 0393253 | 10/1990 | European Pat. Off. | 206/117.17 |

*Primary Examiner*—Jimmy G. Foster
*Attorney, Agent, or Firm*—Rodgers & Rodgers

[57] ABSTRACT

A heavy duty article carrier for packaging cans disposed horizontally includes bottom, top, side and end walls. A composite top wall includes a pair of hand hole apertures and a score line is formed in each side wall near the top edge thereof and the ends of these side score lines are connected with a weakened severance line which adjoins a diagonal score line formed at each corner of the carrier top wall. In addition, a score line is formed in each end wall near the top thereof and each end of these end score lines is interconnected with the adjacent end edge of the top wall and with the adjacent end of an adjacent diagonal weakened severance line formed in the top wall.

5 Claims, 3 Drawing Sheets

HEAVY DUTY ARTICLE CARRIER FOR CANS ARRANGED IN A HORIZONTAL POSITION

TECHNICAL FIELD

This invention relates generally to hand held article carriers and is concerned primarily with score lines formed in each side wall and in each end wall near the upper edges of these walls together with weakened severance lines which interrelate these score lines with diagonal score lines formed in a top wall of the carrier at each corner thereof.

BACKGROUND ART

U.S. patent application Ser. No. 65,277 filed May 21, 1993 and owned by the assignee of this invention discloses an article carrier having special score lines formed in its top wall and arranged so as to aid in distributing the load of the carrier and thereby to facilitate the use of lower caliper paperboard than is customarily required for heavy duty carriers.

SUMMARY OF THE INVENTION

According to this invention in one form a heavy duty article carrier is specially constructed so as to distribute the load of horizontally disposed cans thereby to make possible the use of lower caliper paperboard than is currently required for heavy duty carriers which comprise bottom, top, side and end walls wherein a horizontal score line is formed in each side wall near the top edge thereof and a similar score line is formed in each end wall of the carrier near the top edge thereof, the ends of both the side score and the end score are connected with weakened severance lines which are interconnected with diagonal fold lines formed in the top wall at each corner of the carrier.

BEST MODE OF CARRYING OUT THE INVENTION

Figure 1:
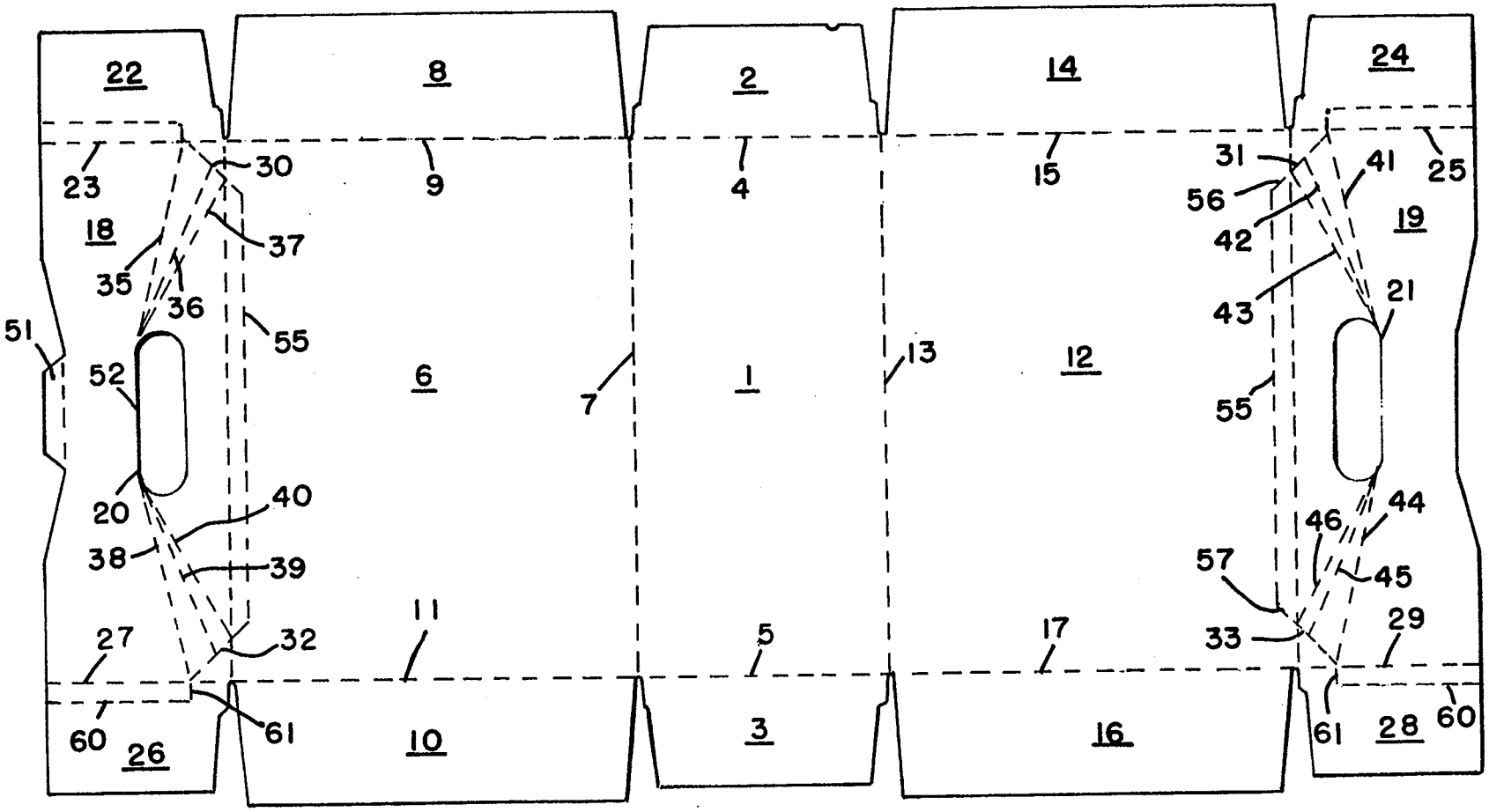
FIG. 1 is a plan view of a carrier blank as seen from the inside of the blank.

With reference to FIG. 1, the numeral 1 designates the bottom wall of the carrier and the numerals 2 and 3 designate end flaps foldably joined respectively to each end of bottom wall 1 along fold lines 4 and 5 respectively. A side wall 6 is foldably joined to bottom wall 1 along fold line 7 and an end flap 8 is foldably joined to side wall 6 along fold line 9 and end flap 10 is foldably joined to an end edge of side wall 6 along fold line 11. On the other side of bottom wall 1, side wall 12 is formed and is foldably joined to a side edge of bottom wall 1 along fold line 13. End wall panel 14 is foldably joined to side wall 12 along fold line 15 and end wall panel 16 is foldably joined to an end edge of side wall 12 along fold line 17.

The top wall of the carrier is a composite structure formed of two main parts designated by the numerals 18 and 19. A hand gripping aperture 20 is formed in panel 18 and a similar hand gripping aperture 21 is formed in panel 19. Top end flap 22 is foldably joined to panel 18 along fold line 23 and a similar complementary end flap 24 is foldably joined to panel 19 along fold line 25. Top end flap 26 is foldably joined to panel 18 along fold line 27 and top end flap 28 is foldably joined along fold line 29 to panel 19.

A weakened diagonal severance line 30, 31, 32 and 33 is formed at each corner of the top wall.

Score lines 35, 36 and 37 are formed in panel 18 at one end thereof and similar score lines 38, 39 and 40 are formed in panel 18. Similar score lines 41, 42 and 43 are formed in panel 19 as are score lines 44, 45 and 46.

Figure 2:
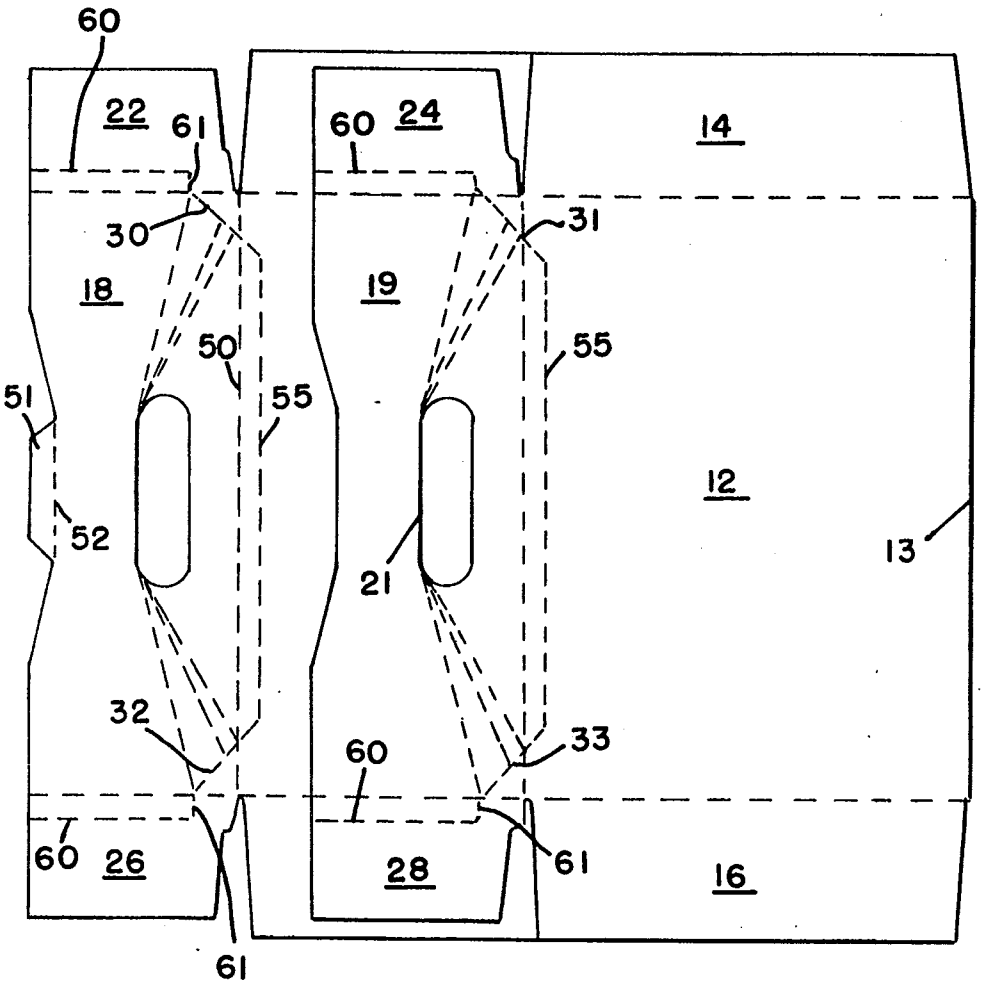

In order to form a completed carrier from the blank shown in FIG. 1, side panel 12 as well as end wall panels 14 and 16 and top wall panel 19 and end wall panels 24 and 28 are elevated and folded to the left along fold line 13. After this operation is complete the structure appears as shown in FIG. 2.

Thereafter panel 18 together with top end flaps 22 and 26 are elevated and folded to the right along fold line 50. Upon completion of this folding operation the structure appears as shown in FIG. 3.

A cushioning flap 51 is formed along a fold line 52.

Figure 3:
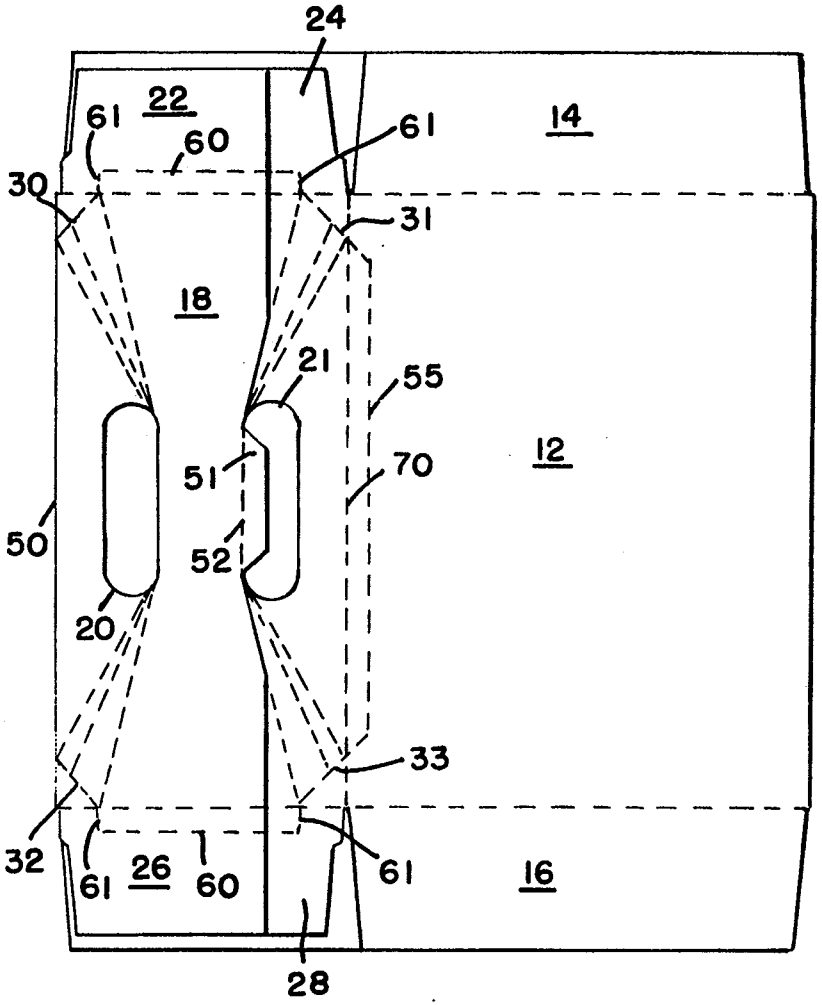
FIGS. 2 and 3 show positions which the carrier parts occupy when the blank of FIG. 1 is manipulated into a collapsed carrier which when set up is shown in FIG. 4. Cans arranged in horizontal positions are indicated in FIG. 5.
Figure 4:
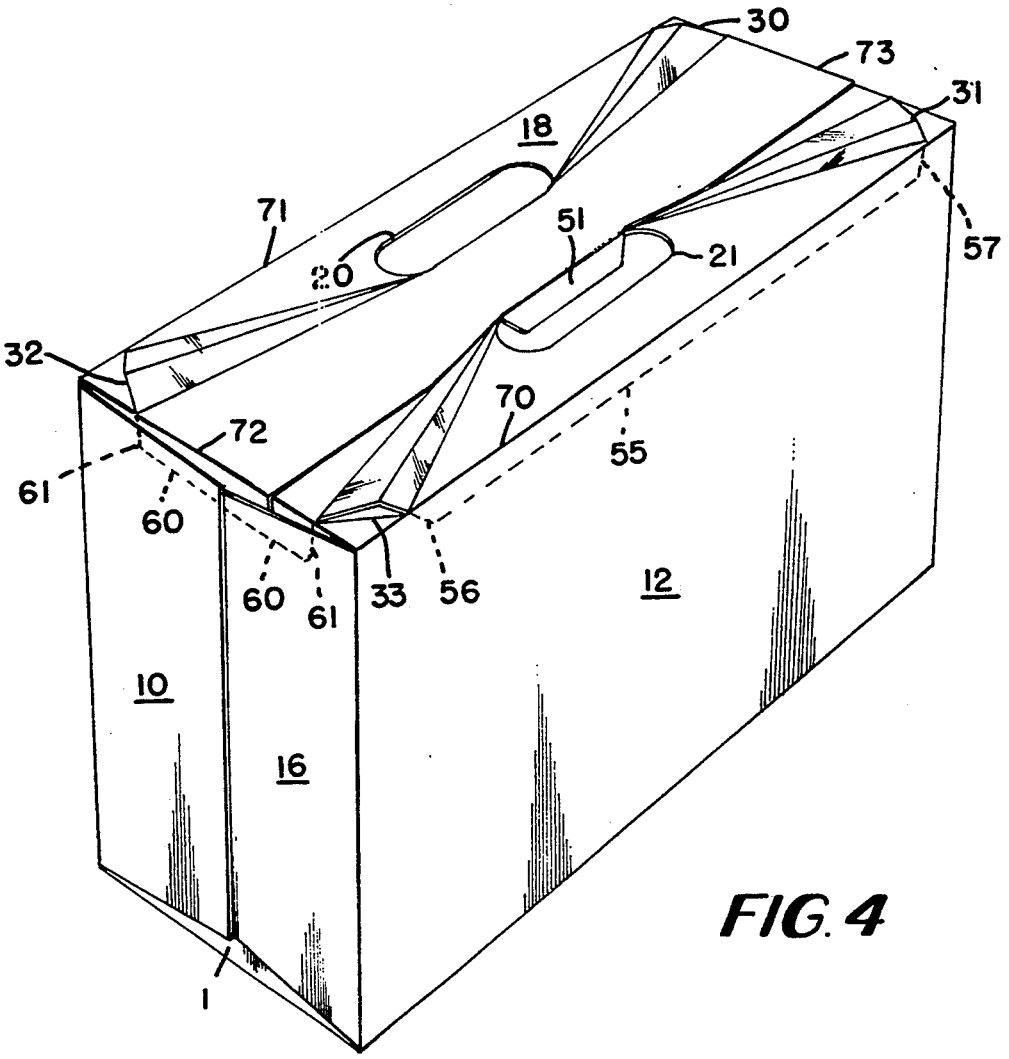

In order to set the carrier up from its collapsed position as shown in FIG. 3 to the completed carrier as shown in perspective in FIG. 4, the bottom panel 1 is held in position and the bottom end flaps 2 and 3 are folded upwardly as the top end flaps 22, 26, 24 and 28 are folded downwardly. Thereafter the end wall panels 8, 10, 14 and 16 are folded inwardly and the composite top wall panel is retained in the position shown in FIG. 3 by a suitable application of glue as is well known.

As is best represented in FIG. 4, side score line 55 is formed in the side wall 12. The side score line 55 is connected at its ends with weakened severance lines 57 and 56 which are interconnected with diagonal weakened severance lines 31 and 33 respectively and end score line 60 is formed in top end flaps 26 and 28 and is connected with weakened severance lines 61 which is connected with weakened diagonal severance line 32 and 33. Weakened severance lines such as 61 and associated structure are formed in the opposite end of the carton as shown in FIGS. 2 and 3.

Figure 5:
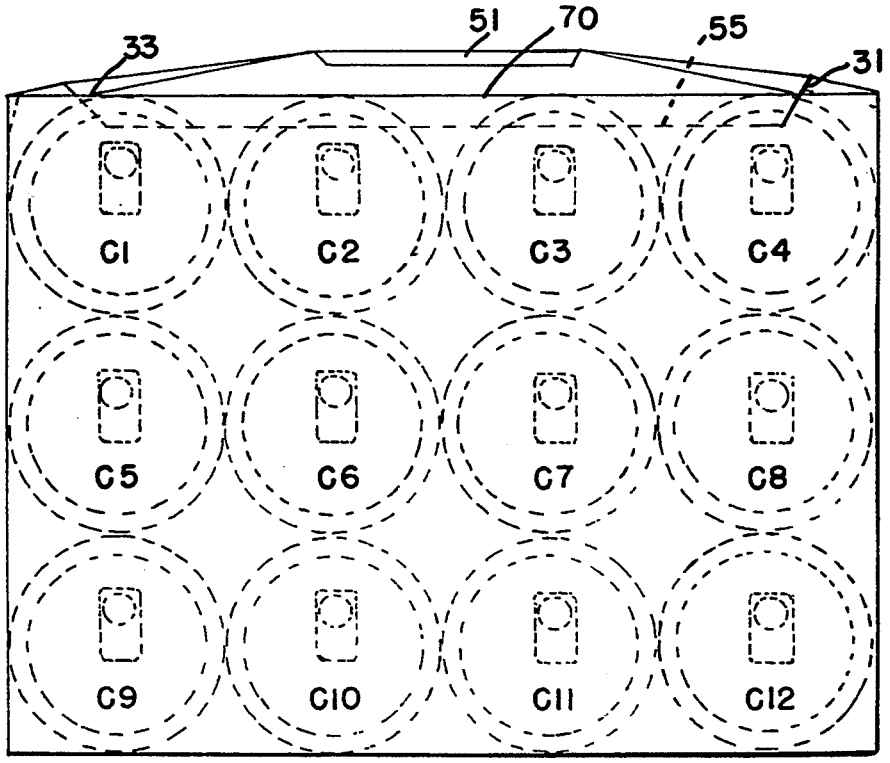

With the side score line such as 55 formed in each side wall such as 6 and 12 along the upper portion thereof and with its ends interconnected by weakened severance lines 56 and 57 which interconnect with the diagonal corner weakened severance lines such as 30, 31, 32 and 33 the side by side horizontal cans as shown in FIG. 5 are tangentially related for example with the upper chimes of cans C1, C2, C3 and C4 by use of the side score lines such as 70 on both sides of the carrier a significant lessening of stress on the composite handle panel occurs according to one feature of this invention. Also the end score line 60 formed in each end of the carrier and near the top wall of the carrier, significant reduction in stress which is transmitted to the handle occurs due to the coaction of the cans with the weakened severance line 61 which extend from each end of the score line 60 to the adjacent end of the adjacent diagonal score line 30, 31, 32 and 33 formed at each corner of the top wall.

With significant reductions of stress according to this invention a significant reduction in the caliper of paperboard required to form a secure package for horizontal cans. Thus according to this invention significant savings in the cost of paperboard are achieved without impairing package integrity.

We claim:

1. An article carrier for packaging a plurality of articles and comprising a bottom wall having opposed side and end edges, a bottom end flap foldably joined to each end edge of said bottom wall, side walls having opposed end edges and having top and bottom edges foldably joined along their bottom edges to side edges of said bottom wall, an end wall panel foldably joined along a side edge thereof to each end edge of each of said side walls, a composite top wall having opposed side and end edges foldably joined along its side edges to the top edges of said side walls respectively, a top end flap foldably joined to each end edge of said top wall and secured in flat face contacting relation to each adjacent end wall panel, finger receiving hand hole aperture means formed in said top wall, a weakened diagonal severance line formed in said top wall and disposed astride each corner thereof, an end score line formed in each of said top end flaps adjacent the end of the top wall, a weakened severance line in each top end flap and extending from one end of each of said end score lines to the end edge of said top wall to intersect the adjacent weakened diagonal severance line.

2. An article carrier for packaging a plurality of articles and comprising a bottom wall having opposed side and end edges, a bottom end flap foldably joined to each end edge of said bottom wall, side walls having opposed end edges and having top and bottom edges foldably joined along their bottom edges to side edges of said bottom wall, an end wall panel foldably joined along a side edge thereof to each end edge of each of said side walls, a composite top wall having opposed side and end edges foldably joined along its side edges to the top edges of said side walls respectively, a top end flap foldably joined to each end edge of said top wall and secured in flat face contacting relation to each adjacent end wall panel, finger receiving hand hole aperture means formed in said top wall, a weakened diagonal severance line formed in said top wall at each corner thereof, an end score line formed in each of said top end flaps adjacent the end of the top wall, a weakened severance line in each to end flap and extending from one end of each of said end score liens to the end edge of said top wall to intersect the adjacent weakened diagonal severance line, a side score line formed in each side wall near the top edge thereof, and a weakened severance line formed in each side wall at each end of each of said side score lines and intersecting the end of the adjacent diagonal weakened severance line formed in said top wall.

3. An article carrier according to claim 2 wherein each of said side score lines is parallel to the top edge of the associated side wall.

4. An article carrier for packaging a plurality of articles and comprising a bottom wall having opposed side and end edges, a bottom end flap foldably joined to each end edge of said bottom wall, side walls having opposed end edges and having top and bottom edges foldably joined along their bottom edges to side edges of said bottom wall, an end wall panel foldably joined along a side edge thereof to each end edge of each of said side walls, a composite top wall having opposed side and end edges foldably joined along its side edges to the top edges of said side walls respectively, a top end flap foldably joined to each end edge of said top wall and secured in flat face contacting relation to each adjacent end wall panel, finger receiving hand hole aperture means formed in said top wall, a weakened diagonal severance line formed in said top wall at each corner thereof, an end score line formed in each of said top end flaps adjacent the end of the top wall, a weakened severance line in each to end flap and extending from one end of each of said end score liens to the end edge of said top wall to intersect the adjacent weakened diagonal severance line, and a side score line and a pair of weakened severance lines formed in each of said side walls and wherein each of said weakened severance lines extends from one end of each of said side score lines to the adjacent end of the adjacent one of said weakened diagonal severance lines.

5. An article carrier according to claim 4 wherein a plurality of score lines are formed in said composite top wall each one of which extends from said hand hole aperture means to an end of one of said diagonal severance lines.

* * * * *